US006486603B1

(12) United States Patent
Ikeuchi et al.

(10) Patent No.: US 6,486,603 B1
(45) Date of Patent: Nov. 26, 2002

(54) HIGH-FREQUENCY EXCITATION POINT LIGHT SOURCE LAMP DEVICE

(75) Inventors: Mitsuru Ikeuchi, Himeji (JP); Yukiharu Tagawa, Himeji (JP); Hiroyuki Fujii, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/515,332

(22) Filed: Feb. 29, 2000

(30) Foreign Application Priority Data

Oct. 1, 1999 (JP) ..... 11-281928

(51) Int. Cl.[7] ..... H01J 61/67; H01J 61/30
(52) U.S. Cl. ..... 313/639; 313/491
(58) Field of Search ..... 313/639, 640, 313/491, 607, 234, 623; 315/248

(56) References Cited

U.S. PATENT DOCUMENTS 4,427,925 A * 1/1984 Proud et al. ..... 315/248
4,498,029 A 2/1985 Yoshizawa et al.
4,783,615 A * 11/1988 Dakin ..... 315/248
5,043,627 A * 8/1991 Fox ..... 313/491
5,384,515 A * 1/1995 Head et al. ..... 313/607
5,614,780 A 3/1997 Suzuki et al.
5,949,180 A 9/1999 Walker
5,998,934 A * 12/1999 Mimasu et al. ..... 315/248

FOREIGN PATENT DOCUMENTS

| | | |
|---|---|---|
| EP | 02018021 | 1/1990 |
| EP | 0897190 A2 | 2/1999 |
| EP | 0917180 A1 | 5/1999 |
| EP | 0917180 A1 * | 5/1999 |
| JP | 3-225744 | 10/1991 |

* cited by examiner

*Primary Examiner*—Stephen Husar
*Assistant Examiner*—Bao Truong
(74) *Attorney, Agent, or Firm*—Nixon Peabody LLP; David S. Safran

(57) ABSTRACT

To provide a lamp device that is a point light source, that withstands high pressure, and that produces high-intensity light, a high-frequency excitation point light source lamp device has been devised having a discharge vessel made of a transparent, non-conductive material and having an expanded part forming a discharge space and with tubules joined to the expanded part; at least one discharge concentrator, that concentrates the electrical field within the discharge space of the expanded part, which is supported in a tubule with an end within the discharge space; and a high-frequency supply external to the lamp for providing excitation energy that excites a discharge of the concentrator.

18 Claims, 3 Drawing Sheets

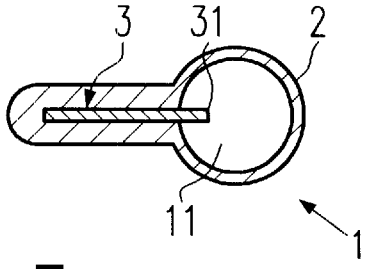
Fig. 7
Fig.8(a)
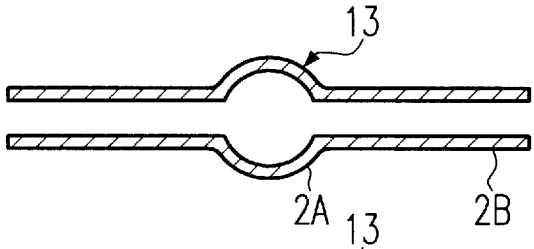
Fig.8(b)
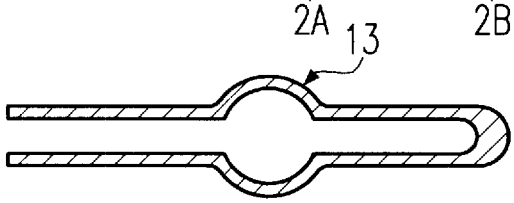
Fig.8(c)
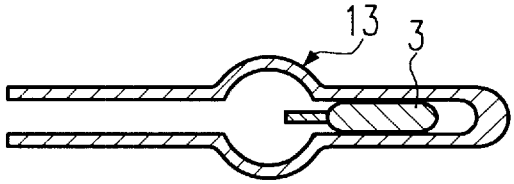
Fig.8(d)
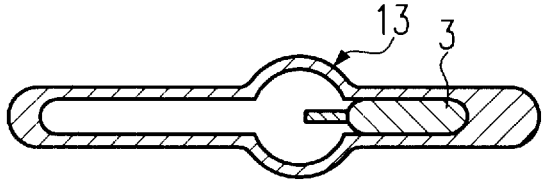
Fig.8(e)
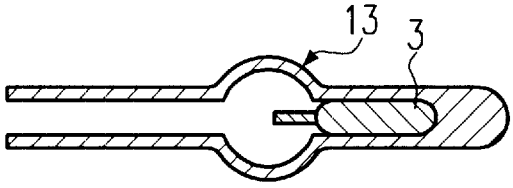
Fig.8(f)
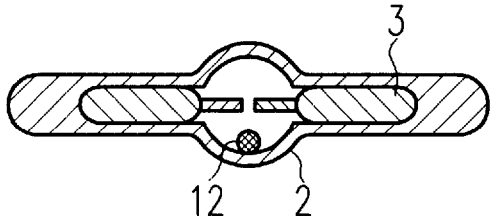

HIGH-FREQUENCY EXCITATION POINT LIGHT SOURCE LAMP DEVICE

BACKGROUND OF THE INVENTION

1. Field of the Invention

This invention concerns a discharge lamp used as a point light source.

2. Description of Related Art

In recent years, liquid crystal projectors have been used as a presentation tool in conferences, exhibitions and so on. A liquid crystal screen can be projected onto a projection screen by means of a high-intensity light source, but in the past the high-intensity light sources used for liquid crystal projectors have been very high-pressure mercury lamps or metal halide lamps which have a pair of facing electrodes within a bulb of silica glass and a given light-emitting substance sealed into the glass bulb. Such lamps are then sealed closed using a foil seal or a rod seal.

Recently, however, there has been increasing market demand for liquid crystal projectors of greater brightness, and consequent demand for brighter light sources for that use. Most recently, very high-pressure mercury lamps with a high sealing pressure have been taking over the leading role from metal halide lamps. However, because there are limits to the pressures that can be withstood by the seals of very high-pressure mercury lamps sealed with foil seals, they are expected to reach their limits for increased intensity within the near future.

Therefore, non-electrode lamps that do not have foil seals are conceivable, in terms of pressure resistance, as alternative light sources for projectors. However, the type of discharge has been considered is the tube-stabilized discharge type which requires forced cooling because the arc discharge follows the tube wall of the discharge vessel and imposes a thermal load on the tube walls of the discharge vessel. Moreover, the arc discharge cannot be confined to the center of the lamp, and is completely unsuitable as a point light source.

Accordingly, a lamp with the structure shown in Japanese Patent HEI-225744 (1991) was proposed as a light source without a foil seal. This is a low pressure discharge lamp, and can be used for such things as back lighting in miniature liquid crystal televisions. A pair of cylindrical, metal, internal electrodes are fixed in the terminals of the discharge vessel; external electrodes are placed on the outer wall of the glass seal corresponding to the cylindrical internal electrodes, forming a condenser of the glass seal sandwiched between the external electrodes and the cylindrical internal electrodes. When a high-frequency voltage is impressed on the external electrodes, power is fed to the cylindrical internal electrodes. However, this lamp is a low-pressure discharge lamp that uses the ultraviolet radiation generated by discharge between the internal electrodes by converting it to visible light by means of a fluorescent layer on the inner wall of the discharge vessel; it cannot be used as a point light source.

SUMMARY OF THE INVENTION

The primary object of this invention, therefore, is to provide a lamp device that is a point light source, that can withstand high pressure, and that can produce high-intensity light.

The above object of this invention is achieved by a high-frequency excitation point light source lamp device comprising: a discharge vessel made of a transparent, non-conductive material and having an expanded part with tubules joined to it; a lamp having a discharge concentrator that concentrates the electrical field within the discharge space of the expanded part, the tips of which are supported by the tubules and face each other within the discharge space; and a means external to the lamp that supplies high-frequency excitation energy that excites a discharge of the concentrator.

Moreover, this invention can have a high-frequency power supply as the means to provide the high-frequency excitation energy, and will be a high-frequency excitation point light source lamp device in which the discharge is excited by capacitance coupling. Or it can have a microwave source as the means to provide the high-frequency excitation energy, and will be a high-frequency excitation point light source lamp device in which the discharge is excited by electromagnetic resonance. Thus, in the event that it has a microwave source as the means to provide the high-frequency excitation energy, it will be a high-frequency excitation point light source lamp device in which the materials receiving the microwaves are placed on the outer periphery of the tubule.

Moreover, the discharge concentrator has a pair of tips facing each other within the discharge space. It is preferable that the gap between the tips of the concentrator be less than the inner diameter of the expanded part. It is also possible to have a single discharge concentrator. In addition, it is preferable that the back ends of the discharge concentrator be reduced in diameter, or that the back ends of the discharge concentrator have a curved surface. And it is preferable that the tips of the discharge concentrator be pointed.

Additionally, it is preferable to select as the material for the discharge concentrator a material having a critical temperature of use that is higher than the critical temperature of use of the nonconductive material of the discharge vessel. Moreover, it is preferable that the material selected for the discharge concentrator have lower wettability than the non-conductive material of the discharge vessel. It is also possible to select a dielectric material as the material for the discharge concentrator.

Silica glass or a transparent ceramic can be selected as the non-conductive material of the discharge vessel. It is possible to have 300 mg/cc or more mercury sealed within the lamp, or to have xenon sealed within the lamp with a sealing pressure of at least 6 MPa at 300 K. Moreover, the gap between the discharge vessel and the discharge concentrator can be filled with mercury. In the event that the high-frequency excitation energy is provided by a high-frequency power supply, it is preferable that the lamp be lit by a high frequency of at least 100 MHz.

The lamp device of this invention is constructed with a discharge vessel of a non-conductive material, and the concentrator is contained entirely within the discharge vessel. Because there is no seal where a current conductor passes to the outside of the lamp, as in the prior technology, the gas pressure that can be withstood within the lamp during discharge is high.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 7 is a cross-sectional view of a further embodiment of the lamp of this invention; and FIGS. 8(*a*) to 8(*f*) are explanatory drawings showing the manufacturing process for the lamp of this invention.

DETAILED DESCRIPTION OF THE INVENTION

Figure 1:
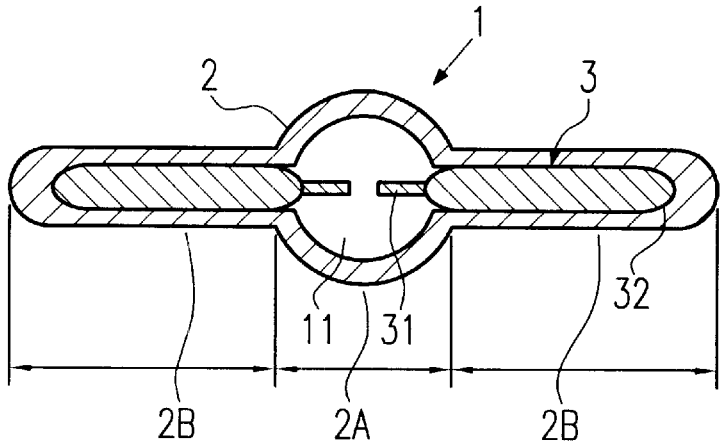
FIG. 1 is a cross-sectional view of one embodiment of the lamp of this invention.

FIG. 1 is a cross-sectional drawing to explain the lamp of the lamp device of this invention. The discharge vessel 2 of lamp 1 is made of a transparent, non-conductive material, and has an expanded part 2A to which are connected tubules 2B. The discharge concentrator 3 is supported by the tubules 2B. The discharge concentrator 3 concentrates and strengthens the electrical field within the discharge space 11, and thus serves to concentrate the discharge. The concentrator tips 31 face each other within the discharge space 11. Thus, the material of the discharge concentrator 3 is selected such that it has a critical temperature of use higher than the critical temperature of use of the non-conductive material that makes up the discharge vessel 2, and a dielectric material can be used. Amounts of a light emitting substance, such as mercury, and an inert gas as a buffer gas are sealed in the discharge space 11.

Figure 2:
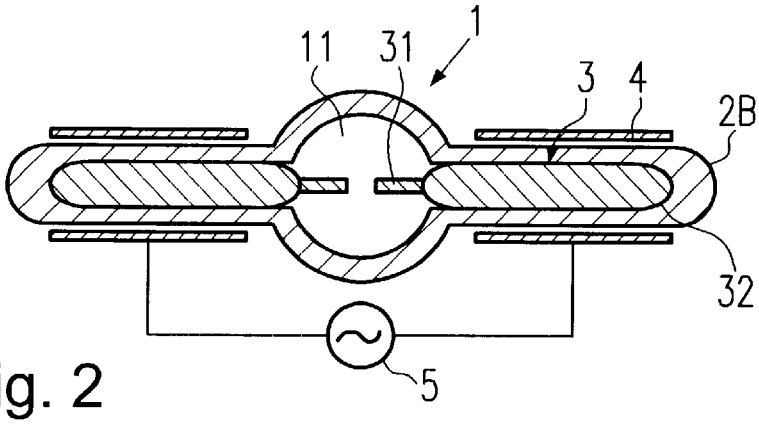
FIG. 2 is a cross-sectional view showing the structure of the lamp of this invention.

FIG. 2 is a schematic cross section of the first embodiment of the lamp device of this invention. External conductors 4 are located outside the tubules 2B of the lamp 1, and the external conductors 4 are connected to a high-frequency power supply 5. When the high-frequency voltage from the high-frequency power supply 5 is impressed on the external conductors 4, the discharge concentrator 3 and the external conductors 4 with the discharge vessel sandwiched between them form a condenser, forming a capacitance coupling which supplies power to the discharge concentrator 3. Then, the electrical field within the discharge space 11 is concentrated and strengthened by the discharge concentrator 3, until a discharge occurs between the two tips 31 of the discharge concentrator 3 and a high-intensity point light source is formed. It is preferable that the discharge concentrator 3 have a greater diameter within the tubules 2B to increase the capacitance of the condenser that is formed.

In actual use, a focusing mirror external to the lamp device (as at 7 in FIG. 3) can be used to focus the light, and it can be used for a variety of light source applications, including a light source for a liquid crystal projector. It is preferable that the frequency of power supply be at least 100 MHz, since that produces an electron trap and prevents electrode voltage drop, thus making it possible to increase the efficiency of light emission.

Figure 3:
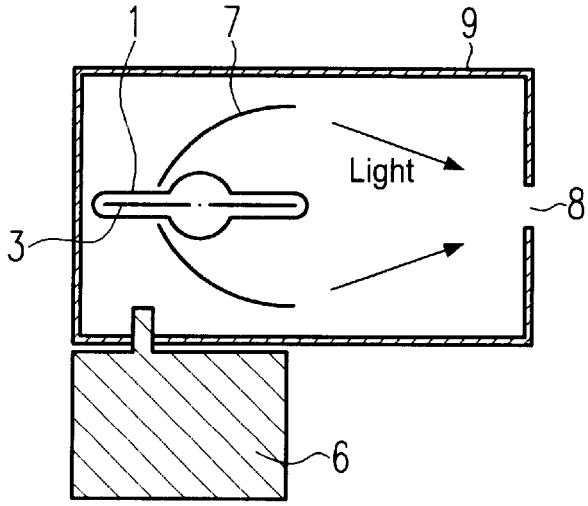
FIG. 3 is a cross-sectional view of the structure of a second embodiment of the lamp device of this invention.

FIG. 3 is a schematic drawing showing a second embodiment of the lamp device of this invention. In this embodiment, the lamp 1 is fed microwaves and made to emit light. Lamp 1 is located within an electromagnetically isolated microwave resonance chamber 9. A microwave source 6 supplies microwaves to the microwave resonance chamber 9. A reflecting mirror 7 for focusing the light is provided in the microwave resonance chamber 9, and a window 8 is provided to let the light emitted out of the chamber 9. When microwaves are produced by the microwave source 6, a radio wave resonance action supplies power to the discharge concentrator 3 in the lamp 1. The electrical field within the discharge space 11 is concentrated and strengthened by the discharge concentrator 3, until a discharge occurs between the two tips 31 of the discharge concentrator 3 and a high-intensity point light source is formed. In this second embodiment, there is no external conductor 4, high-frequency power supply 5 or connecting wiring as in the first embodiment, and as a result, the lighting efficiency of the lamp is increased over that of the first embodiment of the lamp device.

Figure 6:
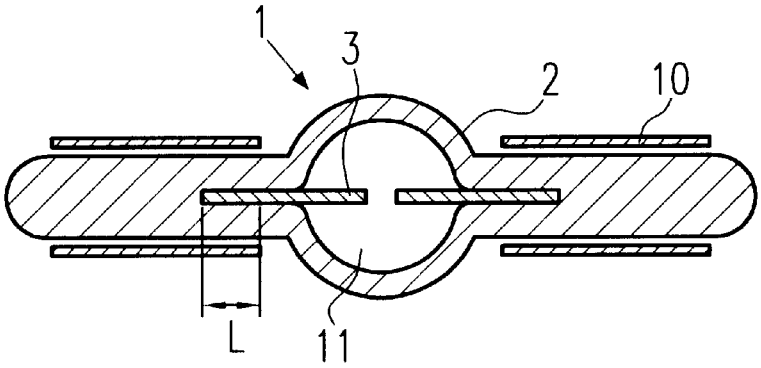
FIG. 6 is a cross-sectional view of another embodiment of the lamp of this invention.

In this second embodiment, it is possible to shorten the discharge concentrator 3 within tubules 2B, and place a receptor material 10, which will receive the microwaves, around the outer periphery of the tubules 2B, as shown in FIG. 6. When this structure is used, there is little energy lost as heat, due to the thermal transmittance to discharge concentrator 3, and adherence to the discharge vessel 2 can be assured, so that the lamp 1 has a highly reliable resistance to pressure. In this situation, the discharge concentrator within the lamp also functions as a microwave receptor material.

The discharge concentrator 3 has tips 31 facing each other within discharge space 11, and the gap between the two facing tips 31 is preferably less than the inside diameter of the expanded part 2A of the discharge vessel 2. If so, it will be possible for discharges that occur in the discharge space 11 to be kept away from the tube wall and concentrated between the tips 31 of the discharge concentrator 3. In earlier non-electrode lamps lighted by high-frequency waves or microwaves, discharge would occur in contact with the discharge vessel, which would raise the discharge vessel wall to a high temperature, so that a means of forced cooling of the vessel was required. In the lamp device of this invention, however, the discharge is kept away from the tube wall, and it is possible to cool it with the same process used for a conventional double-seal, metal halide lamp or a high-pressure mercury lamp.

The discharge concentrator 3 does not necessarily have a pair of tips 31 facing within discharge space 11; as shown in FIG. 7, it is possible to have a discharge concentrator 3 with a single tip 31 facing into the discharge space 11. In that case, the operating principle is not certain, but it is hypothesized that the electrical field is concentrated on the tip of the single discharge concentrator 31, discharge begins, and as the emission of light intensifies, the arc is constricted by a drive force attempting to minimize energy loss due to the emission of light. In this example, use of the lamp in combination with a reflecting mirror improves the lighting efficiency over that of a lamp device with a pair of discharge concentrators.

By selecting the material for the discharge concentrator 3 such that it has a critical temperature of use that is higher than the critical temperature of use of the non-conductive material of the discharge vessel, it is possible to increase the temperature of the parts in contact with the plasma, and as a result, the lamp can be used at input levels that heighten the lighting intensity.

With regard to the shape of the discharge concentrator 3, when the back ends 32 are of reduced diameter, it is possible to increase the resistance to pressure of the tubules 2B of the discharge vessel 2. Moreover, by selecting as the material for the discharge concentrator 3, a material with less wettability than the non-conductive material that makes up the discharge vessel 2, it is possible to bring about a close adherence between the inner walls of the tubule 2B and the discharge concentrator 3 by means of thermal deformation of the discharge vessel 2. It is thus possible to suppress any gap discharge and reduce electrical loss. When the discharge vessel 2 is made up of silica glass, it is easy to process the shape of the discharge vessel 2, and the feature of high thermal resistance enables the close adherence of the discharge concentrator 3.

Figure 4:
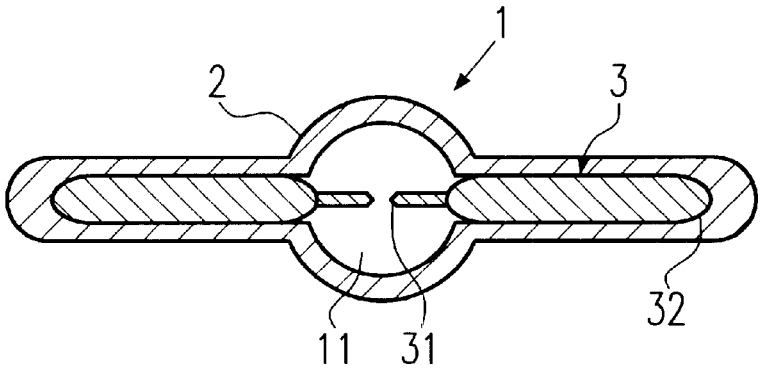
FIG. 4 is a cross-sectional view of another embodiment of the lamp of this invention.

If xenon is sealed in at a pressure of at least 6 MPa at 300 K (room temperature), the discharge is concentrated by the high pressure and it is possible to achieve a nearly white, high-intensity point light source. Sharpening the tips 31 of the discharge concentrator 3 (FIG. 4) is also an appropriate mode of implemention. When the tips 31 are sharp, the electrical field is more easily concentrated by the tips 31 of the discharge concentrator 3, and discharge more easily occurs at startup, and that, moreover, reduces the loss of heat passed to the discharge concentrator 3 in the case of continuous operation.

Figure 5A:
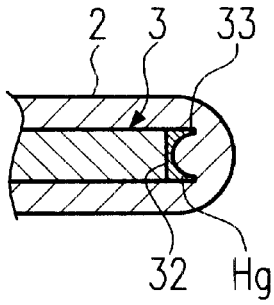
FIGS. 5(*a*) and 5(*b*) are enlarged cross sections of lamp ends.
Figure 5B:
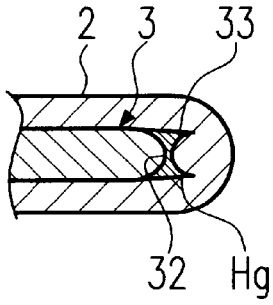

When the back end 32 of the discharge concentrator 3 has a curved surface as illustrated in FIG. 5(*b*), the size of the gap 33 is smaller than when the back end 32 of the discharge concentrator 3 has a flat surface as illustrated in FIG. 5(*a*), making it is possible to suppress power loss due to a corona discharge resulting from concentration of the electrical field at the back end 32.

Moreover, when the gap between the discharge concentrator 3 and the inner walls of the tubules 2B of the discharge vessel 2 are filled with mercury (Hg), it is possible to prevent dielectric-barrier discharge between the discharge concentrator 3 and the external conductor 4 outside the lamp 1, and thus possible to suppress power loss.

It is also possible to select a dielectric as the material for the discharge concentrator 3. In that case, it is possible to use an element which is corrosive to metal as a light-emitting substance, which could not be done if the discharge concentrator 3 were a metallic material.

When the discharge vessel 2 is made up of a transparent ceramic, such as alumina, a highly pressure-resistant vessel becomes possible. In the event that xenon is used as the light-emitting substance, for example, it is possible to use pressures of 5 to $10\times10^7$ Pa. In the even that mercury is used as the light-emitting substance, sealing in a quantity of mercury 12 (FIG. 8 (*f*)) of 300 mg/cc or more will make it possible to concentrate the discharge at a high pressure, and achieve a nearly white, high-intensity point light source.

Before explaining specific implementation examples, the method of manufacturing the lamp of this invention will be explained with reference to FIGS. 8(*a*)–(*f*). The first step is to prepare a tungsten discharge concentrator 3 and a silica glass tube 13 with both ends open, as shown in FIG. 8(*a*). Next, the surface of the discharge concentrator 3, except for the portion that is exposed in the discharge space 11, is plated with rhenium, a metal that has low wettability with respect to silica glass. Then, as shown in FIG. 8(*b*), one end of the glass tube 13 is sealed with a burner. As shown in FIG. 8(*c*), the discharge concentrator 3 is placed in the glass tube 13, a vacuum is created within the glass tube 13, and the other end of the glass tube 13 is closed. Then, as shown in FIG. 8(*d*), the discharge concentrator 3 is fixed in the tubule 2B of the glass tube 13 using a burner.

Next, as shown in FIG. 8(*e*), the end of the glass tube 13 that does not have a discharge concentrator 3 in it is cut open, a given amount of mercury 12 is placed in the glass tube 13, and another discharge concentrator 3 is inserted into the discharge concentrator 3. As shown in FIG. 8(*f*), a vacuum is created within the glass tube 13, argon gas is introduced at a given pressure, and the open end of the glass tube 13 is closed. Then, the discharge concentrator 3 is fixed in the tubule 2B of the glass tube 13 using a burner.

A concrete example of a lamp is explained next. FIG. 2 shows a first lamp device connected to a high-frequency power supply. The lamp power is 150 W. The discharge vessel 2 is made of silica glass with a wall thickness of 2.5 mm, and a 12 mm outer diameter for the expanded part. The discharge concentrator 3 is made of tungsten, and the gap separating the tips is from 0.5 to 0.7 mm. The thick part of the discharge concentrator 3 within the tubules 2B measures 2 mm in diameter. Except for the portion that is exposed within the discharge space 11, the discharge concentrator 3 is covered with a thin film of rhenium.

Although the method of sealing in the discharge concentrator 3 will differ from that used for a silica glass discharge concentrator, it is possible to use a transparent ceramic, such as transparent alumina, transparent yttrium or transparent YAG as the material for the discharge vessel 2. Transparent ceramics are stronger with respect to the thermal load, but applications are limited because they are weaker with respect to thermal shock.

The material of the discharge concentrator 3 is one with a critical temperature of use that is higher than that of the material used for the discharge vessel 2. Specifically, when the light-emitting substance used for the discharge is mercury or an inert gas and the discharge vessel is silica glass, it is possible to use W, Re, Ta or other metals, TaC, ZrC, HfC or other carbides, $Al_2O_3$, BeO, MgO, $ZrO_2$, $ThO_2$, other rare earth oxides, nitrides such as AlN, or composites of the above carbides and nitrides.

In this example, 300 mg/cc of mercury is injected as the discharge light-emitting substance, and an inert gas is injected at a pressure of 13 kPa as a buffer gas. Now, in the event that sulfur (S), selenium (Se) or tellurium (Te) is used as the discharge light-emitting substance, the material of the discharge concentrator 3 will be MgO, $ZrO_2$ or BeO, which are not corroded by sulfur, selenium or tellurium.

The tips 31 of the discharge concentrator 3 are sharpened to a diameter of 0.5 mm, and the back ends 32 are given a curved surface. The external conductor 4 is cylindrical Inconel; other possible materials are heat-resistant alloys and $BaTiO_3$, which has a high dielectric constant. The external conductor 4 can be clamped onto the tubule 2B. The lamp 1 is lit using high-frequency power of 100 to 200 MHz. When the high-frequency power is at 100 MHz, the capacitance of the condenser formed by the glass between the external conductors 4 and the discharge concentrator 3 is about 20 pF.

The lamp 1 was built with the above specifications and the structure in FIG. 2; it was lit as a white, high-intensity light source when impressed with high-frequency power at 150 MHz, and operated with no problems, such as cracking or subsequent darkening. The amount of mercury included was 350 mg/cc and an inert gas was included as a buffer gas at a pressure of 13 kPa, so the pressure within the discharge vessel 2 is thought to have been over 35 MPa during discharge; the pressure withstood by the discharge vessel 2 is considered to be much higher than conventional high-pressure mercury lamps with foil seals. Because there is always Mo foil within conventional foil-seal lamps, if halogen is included, there is a problem of reaction with the Mo. Because there is no Mo used in the current lamps, that problem does not arise.

A lamp device of the second embodiment, as shown in FIG. 3, is explained next. The lamp 1 is located within a electromagnetically shielded microwave resonance chamber 9, and a microwave source 6 is placed so as to provide microwaves to the microwave resonance chamber 9. The lamp power is 200 W. The discharge vessel 2 is made of silica glass with a wall thickness of 2.5 mm, and a 12 mm outer diameter for the expanded part. The discharge concentrator 3 is made of tungsten, and the gap separating the tips is from 0.5 to 0.7 mm. The thick part of the discharge concentrator 3 within the tubules 2B measures 2 mm in diameter.

Except for the portion that is exposed within the discharge space 11, the discharge concentrator 3 is covered with a thin film of rhenium. In the figure, a reflecting mirror 7 is provided to focus the light; it is made of glass or ceramic with a surface layer of a dielectric, such as titania-silica. Because of the use of microwave resonance, metal cannot be used for the reflecting mirror. The light emerges through the window 8. The substances contained within the discharge vessel are Ar at 13 kPa and 300 mg/cc or mercury. The frequency of the microwave source, incidentally, is 2.45 GHz.

In the case of discharge by means of microwave resonance, unlike the first embodiment where power is fed by means of a capacitance coupling, the discharge concentrator 3 also has a role as a receiver. Therefore, receiver material 10 which is separate from the discharge concentrator 3 is placed on the outer periphery of discharge vessel 2, as shown in FIG. 6; this increases the pressure-resistance reliability of the tubules 2B, and reduces thermal losses to the discharge concentrator 3. Because the frequency is high, there is no problem if the coaxial overlap (L is FIG. 6) of discharge concentrator 3 and receiver material 10 is short. The microwave resonance chamber is made of a metal, such as aluminum or copper.

The lamp 1 was built with the above specifications and the structure in FIG. 3; it was lit as a white, high-intensity light source when impressed with a frequency of 2.45 GHz, and operated with no problems, such as cracking or subsequent darkening. The amount of mercury included was 350 mg/cc and an inert gas was included as a buffer gas at a pressure of 13 kPa, so the pressure within the discharge vessel 2 is thought to have been over 30 MPa during discharge. Like the lamp device shown in FIG. 2, the pressure withstood by the discharge vessel 2 is considered to be much higher than conventional high-pressure mercury lamps with foil seals. Because no power supply leads are necessary in this lamp, there is no shadow cast by leads and the light can be used effectively.

Action of the Invention

As explained above, the lamp device of this invention has a discharge vessel made up of a non-conductive material, and the discharge concentrator is contained completely within the discharge vessel. Because there is no seal where current conductors exit from within the lamp, as in the case of conventional lamps, the lamp is strong in terms of resistance to gas pressure within the lamp during discharge. And because the discharge concentrator inside the lamp is faced into the discharge space, the discharge is concentrated at the tip of the discharge concentrator, allowing the achievement of a high-intensity point light source.

What is claimed is:

1. A high-frequency excitation point light source lamp device comprising:

a discharge vessel made of a transparent, non-conductive material which includes an expanded part enclosing a discharge space and at least one tubule joined to the expanded part;

at least one discharge concentrator within the discharge vessel that concentrates an electrical field within the discharge space of the expanded part, wherein the at least one discharge concentrator is supported by the at least one tubule and has a tip within the expanded part of the discharge space; and a means, external to the lamp, for supplying high-frequency excitation energy that excites a discharge of the at least one discharge concentrator.

2. A high-frequency excitation point light source lamp device according to claim 1, wherein the means for supplying high-frequency excitation energy is a high-frequency power supply and a capacitance coupling.

3. A high-frequency excitation point light source lamp device according to claim 1, wherein the means for supplying high-frequency excitation energy is a microwave source for exciting said discharge by electromagnetic resonance.

4. A high-frequency excitation point light source lamp device according to claim 3, wherein materials for receiving microwaves are placed on an outer periphery of the tubule.

5. A high-frequency excitation point light source lamp device according to claim 1, wherein the discharge vessel includes a pair of opposed tubules; wherein said at least one discharge concentrator is a pair of discharge concentrators each having tips which face each other; and wherein the tips of the discharge concentrators that face each other within the discharge space are separated by a gap which is less than an inner diameter of the expanded part.

6. A high-frequency excitation point light source lamp device according to claim 1, wherein a single discharge concentrator is positioned within the discharge vessel.

7. A high-frequency excitation point light source lamp device according to claim 1, wherein a back end of the at least one discharge concentrator is reduced in diameter.

8. A high-frequency excitation point light source lamp device according to claim 1, wherein a back end of the at least one discharge concentrator has curved surfaces.

9. A high-frequency excitation point light source lamp device according to claim 1, wherein said the discharge vessel includes a pair of opposed tubules; wherein said at least one discharge concentrator is a pair of discharge concentrators each having tips which face each other; and wherein the tips of the discharge concentrators are pointed.

10. A high-frequency excitation point light source lamp device according to claim 1, wherein the at least one discharge concentrator is made of a material which has a critical temperature of use that is higher than a critical temperature of use of the non-conductive material of which the discharge vessel is made.

11. A high-frequency excitation point light source lamp device according to claim 1, wherein the at least one discharge concentrator is made of a material selected which has a lower wettability than that of the non-conductive material of the discharge vessel.

12. A high-frequency excitation point light source lamp device according to claim 1, wherein the at least one discharge concentrator is made of a dielectric material.

13. A high-frequency excitation point light source lamp device according to claim 1, wherein the non-conductive material of the discharge vessel is silica glass.

14. A high-frequency excitation point light source lamp device according to claim 1, wherein the non-conductive material of the discharge vessel is a transparent ceramic.

15. A high-frequency excitation point light source lamp device according to claim 1, wherein at least 300 mg/cc of mercury is sealed within the lamp.

16. A high-frequency excitation point light source lamp device according to claim 1, wherein xenon is sealed within the lamp with a sealing pressure of at least 6 MPa at 300 K.

17. A high-frequency excitation point light source lamp device according to claim 1, wherein a gap between the discharge vessel and a rear end of the at least one discharge concentrator is filled with mercury.

18. A high-frequency excitation point light source lamp device according to claim 2, wherein the means for supplying high-frequency excitation provides a high frequency of at least 100 MHz.

* * * * *